US011168887B2

(12) United States Patent
Stankowski

(10) Patent No.: US 11,168,887 B2
(45) Date of Patent: Nov. 9, 2021

(54) FUEL SPRAY NOZZLE

(71) Applicant: ROLLS-ROYCE plc, London (GB)

(72) Inventor: Tomasz Stankowski, Birmingham (GB)

(73) Assignee: ROLLS-ROYCE PLC, London (GB)

( * ) Notice: Subject to any disclaimer, the term of this patent is extended or adjusted under 35 U.S.C. 154(b) by 0 days.

(21) Appl. No.: 17/003,430

(22) Filed: Aug. 26, 2020

(65) Prior Publication Data

US 2021/0095851 A1 Apr. 1, 2021

(30) Foreign Application Priority Data

Sep. 26, 2019 (GB) ..... 1913882

(51) Int. Cl.
*F23R 3/34* (2006.01)
*B05B 1/02* (2006.01)
*F23R 3/28* (2006.01)

(52) U.S. Cl.
CPC ..... *F23R 3/343* (2013.01); *B05B 1/02* (2013.01); *F23R 3/28* (2013.01)

(58) Field of Classification Search
CPC .... F23R 3/28; F23R 3/343; F23R 3/34; F23R 3/38; F23R 3/30; F23D 11/105; F23D 2900/11101; F23D 11/107
See application file for complete search history.

(56) References Cited

U.S. PATENT DOCUMENTS 3,684,186 A * 8/1972 Helmrich ..... F23D 11/107 239/400
3,937,011 A * 2/1976 Caruel ..... F23D 11/107 60/737
4,600,151 A * 7/1986 Bradley ..... F23D 11/107 239/400
4,941,617 A 7/1990 Russell
(Continued)

FOREIGN PATENT DOCUMENTS

EP 2570727 3/2013

OTHER PUBLICATIONS

European search report dated Feb. 3, 2021, issued in EP patent application No. 20192824.
(Continued)

*Primary Examiner* — Scott J Walthour
*Assistant Examiner* — Todd N Jordan

(57) ABSTRACT

Fuel spray nozzle for generating a spray of atomised liquid fuel in a combustor of a gas turbine engine. The nozzle includes a flow circuit that has in flow series: a gallery that receives fuel flow, plural circumferentially-spaced restrictor passages arranged in a row around the nozzle, plural conditioning passages configured to impart a circumferential component to their respective portions of the fuel flow, and an annular spin chamber which forms a swirling fuel flow which is discharged at an exit port. The restrictor passages form flow restrictions which in use produce a pressure differential between the gallery and the spin chamber to
(Continued)

evenly circumferentially distribute the fuel flow between the restrictor passages. The conditioning passages have increased flow cross-sectional areas relative to the flow cross-sectional areas of the restrictor passages, such that the restrictor passages produce substantially all of the pressure differential between the gallery and the spin chamber.

11 Claims, 5 Drawing Sheets

(56) References Cited

U.S. PATENT DOCUMENTS

| | | | | |
|---|---|---|---|---|
| 4,946,105 | A * | 8/1990 | Pane, Jr. | B05B 7/065 239/398 |
| 9,310,073 | B2 * | 4/2016 | Buelow | F23D 11/107 |
| 2012/0228397 | A1 | 9/2012 | Thomson | |
| 2012/0228405 | A1 | 9/2012 | Buelow et al. | |
| 2013/0200179 | A1 | 8/2013 | Buelow et al. | |

OTHER PUBLICATIONS

Great Britain search report dated Apr. 23, 2020, issued in GB Patent Application No. 1913882.5.

* cited by examiner

FUEL SPRAY NOZZLE

CROSS-REFERENCE TO RELATED APPLICATIONS

This specification is based upon and claims the benefit of priority from United Kingdom patent application number GB 1913882.5 filed on Sep. 26, 2019, the entire contents of which is incorporated herein by reference.

BACKGROUND

Technical Field

The present disclosure relates to a fuel spray nozzle for generating a spray of atomised liquid fuel in a combustor of a gas turbine engine.

Description of the Related Art

A gas turbine engine typically comprises, in axial flow arrangement, a fan, one or more compressors, a combustion system and one or more turbines. The combustion system typically comprises a plurality of fuel injectors having fuel spray nozzles which combine fuel and air flows and generate sprays of atomised liquid fuel into a combustion chamber. Correct production of these atomised sprays has a significant impact on combustion efficiency.

Injectors for lean-burn combustion systems each have two fuel flows (within a pilot flow circuit and a main flow circuit) and one or more swirling air flows. As well as atomising the fuel, the air flows serve to maintain separation of the pilot and mains fuel flows until the point of ignition, and to define the flow fields and resulting flame shape in the combustion chamber. Each flow circuit within a given nozzle prepares the respective fuel flow as a swirling thin film on a prefilming surface for introduction into the airstream.

The fuel flow in each of the pilot flow circuit and main flow circuit is typically varied/staged throughout the combustion cycle of the combustion system. At certain times during the combustion cycle (i.e. during engine ignition and at low power operation), the main fuel flow is "staged out" (i.e. ceased) whilst the pilot fuel flow is maintained.

The nozzle of a conventional injector may have an atomiser subassembly formed from concentric tubes that are brazed together. The pilot and main flow circuits are produced by machining channels into the opposing outer surfaces of adjacent tubes. The pilot and mains flow circuits extend generally circumferentially in thermal communication with one another so that flow within the pilot circuit can reduce the wetted wall temperature of the mains flow circuit.

One way for a flow circuit to provide the swirling flow is for the circuit to have a circumferential row of flow restrictors, which are small, angled, elongate passages that cause flow to be evenly distributed around the nozzle while imparting a circumferential component to the flow. However, configuring such restrictors so that fuel flow is uniform around the nozzle and has the required degree of swirl at the prefilming surface can be difficult to achieve, given the restrictions imposed on allowable circuitry shapes by the machining and brazing manufacturing process. These difficulties can be particularly acute in respect of the prefilming surface of the mains flow circuit, which is generally the radially outward of the two prefilming surfaces, and also has to accommodate greater flow rate variation.

Thus there is a need for an improved fuel spray nozzle.

SUMMARY

According to a first aspect of the disclosure there is provided a fuel spray nozzle for generating a spray of atomised liquid fuel in a combustor of a gas turbine engine, wherein the nozzle includes:

a flow circuit having an inlet port for receiving a flow of liquid fuel and having an annular exit port for discharging the received fuel as a swirling fuel flow; and an annular prefilming surface downstream of the annular exit port, and configured such that the swirling fuel flow received from the exit port spreads, as a film of fuel, across the prefilming surface, whereupon one or more swirling air flows generated by the nozzle shear the fuel film towards a trailing edge of the prefilming surface and atomise the fuel film into a spray of fine droplets;

wherein the flow circuit has in flow series:

a gallery which wraps circumferentially around the nozzle and receives the fuel flow from the inlet port;

plural circumferentially-spaced restrictor passages arranged in a row around the nozzle, the restrictor passages receiving respective portions of the fuel flow from the gallery;

plural conditioning passages which respectively receive the portions of the fuel flow from the restrictor passages and are configured to impart a circumferential component to their respective portions of the fuel flow; and an annular spin chamber which receives and recombines the respective portions of the fuel flow from the conditioning passages to form the swirling fuel flow which is discharged at the exit port; and wherein:

the restrictor passages form flow restrictions which in use produce a pressure differential between the gallery and the spin chamber to evenly circumferentially distribute the fuel flow between the restrictor passages; and the conditioning passages have increased flow cross-sectional areas relative to the flow cross-sectional areas of the restrictor passages, such that the restrictor passages produce substantially all of the pressure differential between the gallery and the spin chamber.

By decoupling the flow distributing function performed by the restrictor passages from the flow swirling function performed by the conditioning passages, the nozzle can reliably provide, with low losses, a suitably swirling (a high swirl number) fuel flow at the exit port. In particular the conditioning passages can be dedicated to providing a uniform swirling flow, allowing the restrictor passages to be relieved from this duty so that they can simply be sized for the expected range of flow conditions.

The fuel spray nozzle may have any one or any combination of the following optional features.

Conveniently, the restrictor passages may extend substantially parallel to each other in the axial direction of the nozzle.

The conditioning passages may smoothly increase in flow cross-sectional area with downstream distance from the restrictor passages. This can help to reduce losses in the flow by gently guiding the flow into the spin chamber.

The conditioning passages may be further configured to impart a radial component to their respective portions of the fuel flow.

The flow cross-sectional areas of the conditioning passages may be at least two times, and preferably at least three or four times, the flow cross-sectional areas of the restrictor passages. This can help the restrictor passages to produce substantially all of the pressure differential between the gallery and the spin chamber.

The flow circuit may be a mains flow circuit, the fuel flow received at the inlet port being a mains fuel flow. In this case, the nozzle mat further include a pilot flow circuit for receiving and discharging a separate pilot fuel flow, whereby the nozzle is able to implement staged combustion of the mains and pilot fuel flows.

The flow circuit may be defined by an atomiser subassembly of the nozzle, and conveniently the subassembly may be formed by additive layer manufacture. Indeed, the arrangement of restrictor passages and conditioning passages may be such that the subassembly cannot be produced by conventional subtractive machining. Accordingly, a second aspect of the disclosure provides the use of additive layer manufacture to produce an atomiser subassembly of a fuel spray nozzle of the first aspect, wherein the atomiser subassembly defines the flow circuit (i.e. gallery, restrictor passages, conditioning passages and spin chamber) of the fuel spray nozzle.

A third aspect of the disclosure provides combustion equipment for a gas turbine engine, the equipment including a combustor and plural of the fuel spray nozzles according to the first aspect for generating respective sprays of atomised liquid fuel in the combustor.

A fourth aspect of the disclosure provides a gas turbine engine for an aircraft having an engine core comprising in axial flow series a compressor, the combustion equipment of the third aspect, and a turbine, a core shaft connecting the turbine to the compressor.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
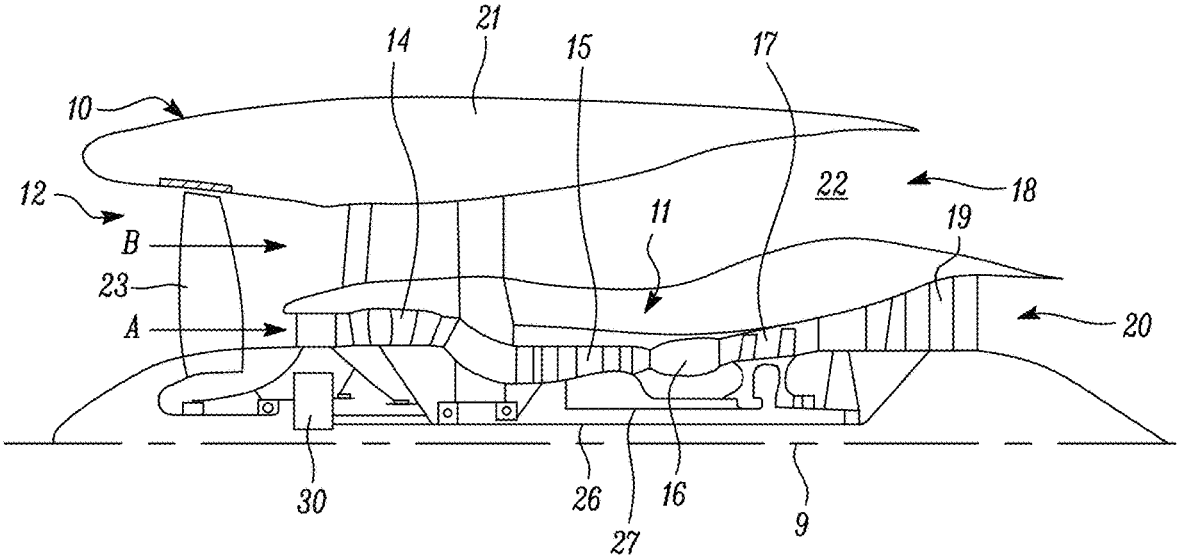
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
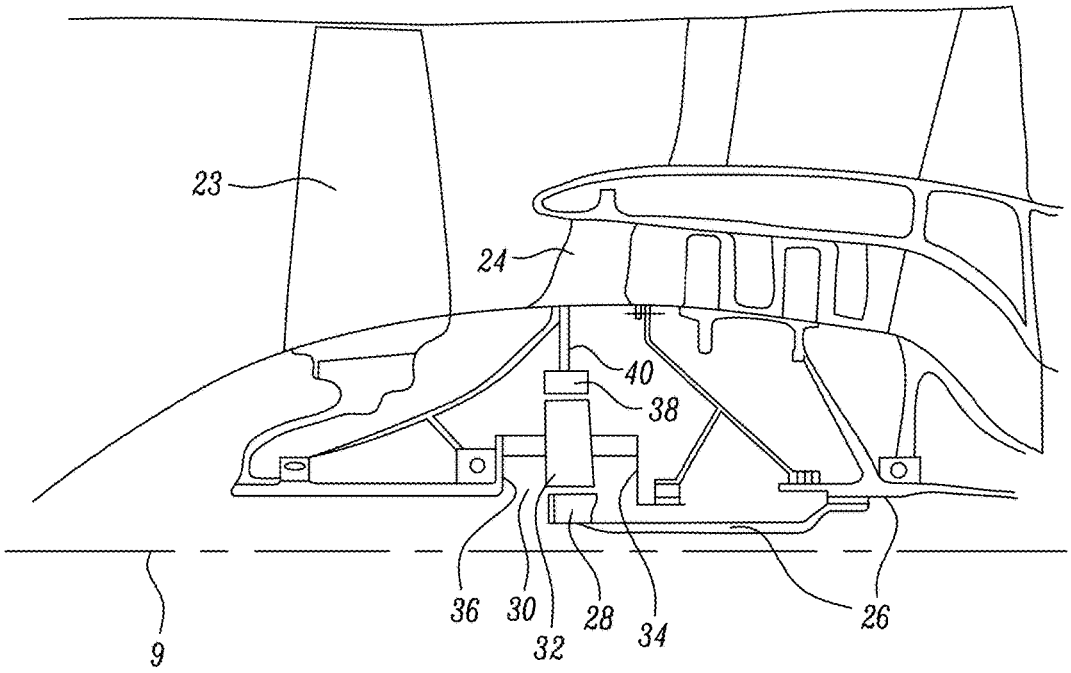
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
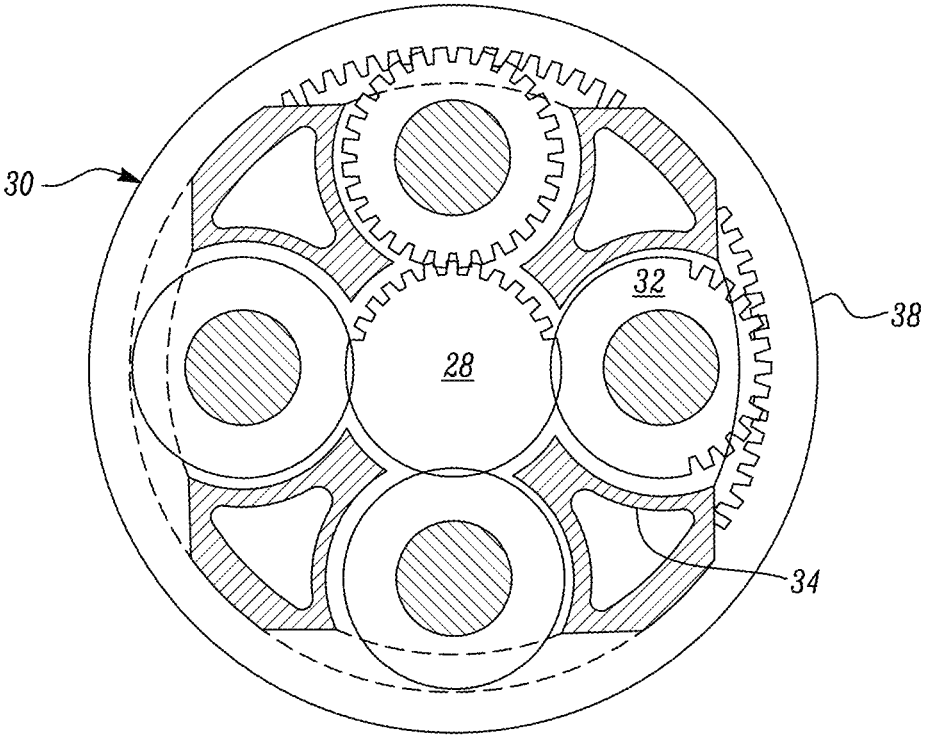
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
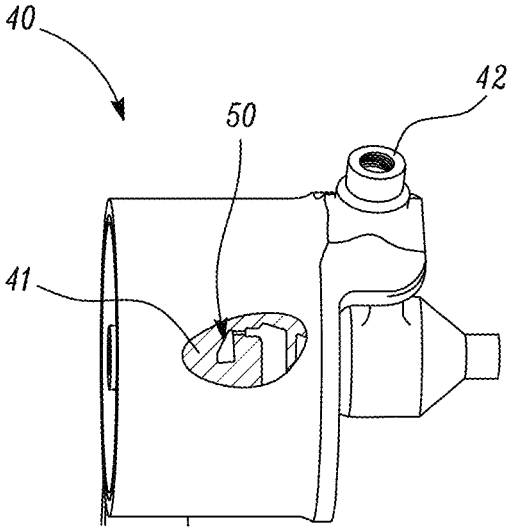
FIG. 4 shows a fuel spray nozzle with a cut away portion revealing part of an atomiser subassembly that defines a mains flow circuit.

The combustion equipment 16 of the engine 10 includes a plurality of fuel injectors having fuel spray nozzles which combine pilot and mains fuel flows and air flows to generate sprays of atomised liquid fuel into a combustion chamber. FIG. 4 shows one these nozzles 40 with a cut away portion revealing part of an atomiser subassembly 41 that defines the mains flow circuit 50 for the mains fuel flow within the nozzle. The nozzle has a connector 42 for joining the nozzle to a feed arm (not shown) of the injector, the feed arm providing passages through which the pilot and mains fuel flows are transported to the nozzle. The pilot fuel flow has its own pilot flow circuit (not shown) in the atomiser subassembly. This circuit has upstream passages which are in close proximity to the mains flow circuit enabling the pilot fuel flow to reduce the wetted wall temperature of the mains flow circuit. Thereafter the pilot flow circuit carries the pilot fuel flow into a central portion of nozzle where a spray is generated from the pilot fuel flow separately from the spray formed from the mains fuel flow. The air flows for forming these fuel sprays (derived from the high pressure air produced by high-pressure compressor 15) enter the right hand side of the nozzle as drawn in FIG. 4, and the fuel sprays exit from the left hand side of the nozzle.

Figure 5:
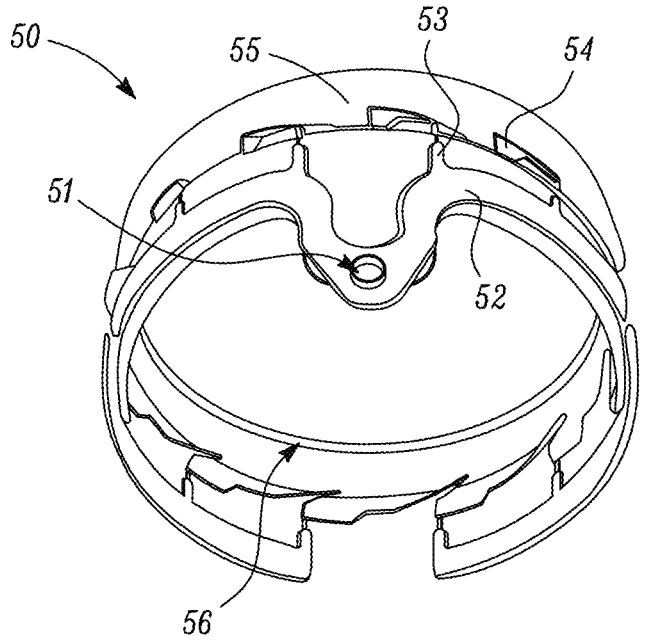
FIG. 5 shows the mains flow circuit in perspective view as a "negative" body
Figure 6:
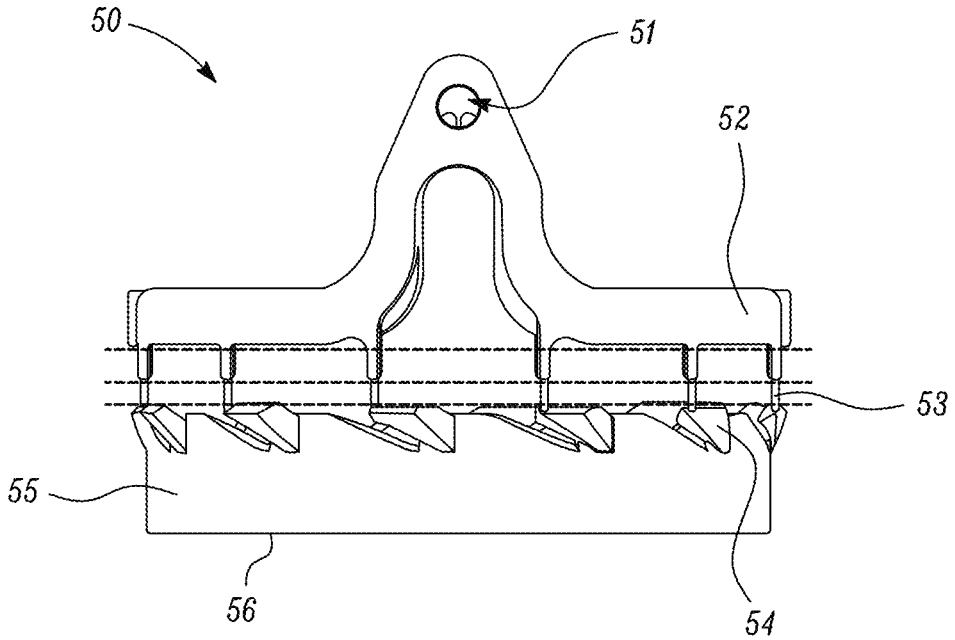
FIG. 6 shows the mains flow circuit in top view as a "negative" body.

The mains flow circuit 50 is shown in perspective view in FIG. 5 and top view in FIG. 6 as a "negative" body (i.e. a solid body representing what is in reality a cavity defined by the atomiser subassembly 41). The mains fuel flow enters the flow circuit at an inlet port 51 from the feed arm, and then flows into a gallery 52 which wraps circumferentially around the nozzle. Plural circumferentially-spaced restrictor passages 53 arranged in a row around the nozzle, receive respective portions of the mains fuel flow from the gallery. Each restrictor passage delivers its portion into a respective a conditioning passage 54, which in turn delivers the portion into an annular spin chamber 55 where the portions from all the conditioning passages are recombined. From an annular exit port 56 at the downstream end of the spin chamber, the mains fuel flow is discharged as a swirling flow onto an annular prefilming surface (not shown) of the nozzle for atomisation at a trailing edge of the surface into a spray of fine droplets.

The restrictor passages 53 (in use) produce a pressure differential between the gallery 52 and the spin chamber 55 to evenly circumferentially distribute the fuel flow between the restrictor passages for the entire range of flow conditions of the mains fuel flow. The conditioning passages 54 then impart a circumferential component to their respective portions of the mains fuel flow, but without producing any significant further pressure differential between the gallery and the spin chamber. This is achieved, at least in part, by the conditioning passages having increased flow cross-sectional areas relative to the flow cross-sectional areas of the restrictor passages.

Advantageously, the atomiser subassembly 41 can be formed by additive layer manufacturing. This enables configurations for the restrictor passages 53 and the conditioning passage 54 to be achieved which would be impossible by conventional subtractive machining. For example, the conditioning passages can be provided with precisely shaped deflector walls, in close proximity to the exits from the restrictor passages, which assist with the flow turning performance of the passages but without impinging on the measuring functionality of the restrictor passages. More generally, computational fluid dynamics (CFD) modelling can be used to inform the shaping of the restrictor 53 and conditioning 54 passages, with the confidence that additive layer manufacturing allows optimised configurations resulting from such modelling to be implemented. Such optimised configurations can minimise losses and gently guide the flow into a swirling motion within the spin chamber 55.

Figure 7:
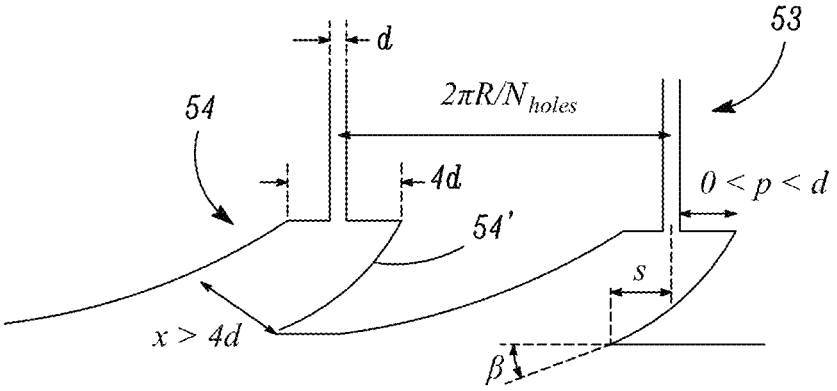
FIG. 7 shows schematically restrictor passages and the conditioning passage of the mains flow circuit.

FIG. 7 shows schematically the restrictor passages 53 and the conditioning passage 54. The restrictor passages extend substantially parallel to each other in the axial direction of the nozzle. The conditioning passages have deflector walls 54' which intercept and align the flow ejected from the axially oriented restrictor passages. Additive layer manufacturing allows the circumferential distance p between the exit from each restrictor passage and the respective deflector wall to be reduced or eliminated entirely. The resultant swirl condition from the conditioning passages is a function of the geometry of the deflector walls, such as exit slope angle $\beta$, and the length s of the deflector walls measured circumferentially from the exits from the restrictor passages. Furthermore, to avoid creating further flow constrictions downstream of the restrictor passages, the flow cross-sectional area x of the conditioning passages may be at least two times larger, and preferably at least three of four times larger than the flow cross-sectional area d of the restrictor passages (FIG. 7 shows x at least four times greater than d). The flow cross-sectional area of the conditioning passages also preferably smoothly increases with downstream distance from the restrictor passages. Optionally, the conditioning passages may be further configured to impart a radial component to the fuel flow.

Figure 8:
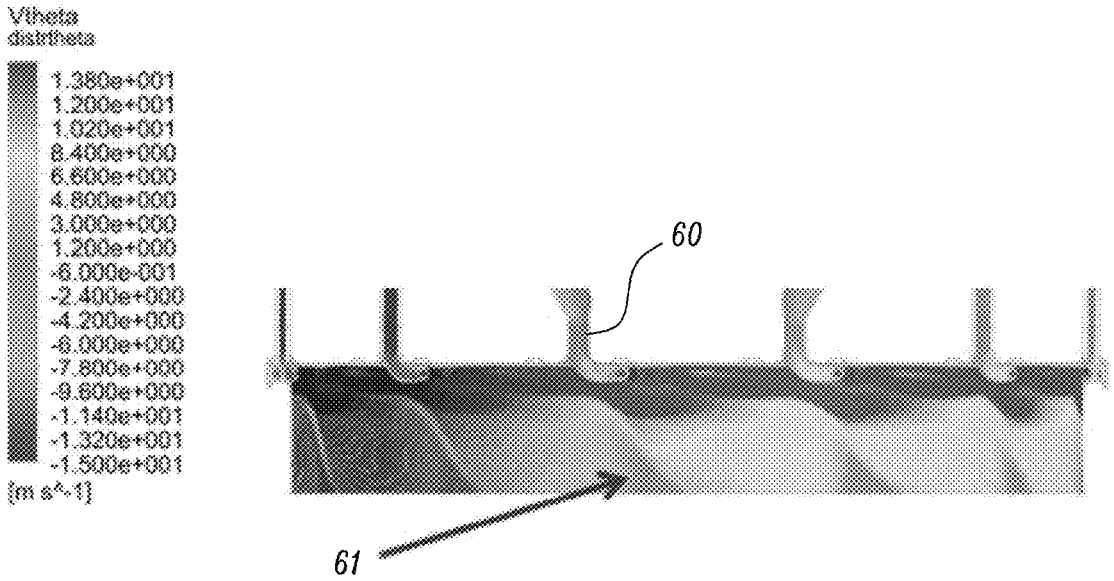
FIG. 8 shows the result of a comparative CFD analysis in which a mains flow circuit is provided with J-shaped passages.

FIG. 8 shows the result of comparative CFD analysis in which a mains flow circuit is provided with J-shaped passages 60 of constant flow cross-sectional area between the gallery and the spin chamber which provide both flow measuring and swirl-producing functions, i.e. the circuit does not have restrictor passages and separate conditioning passages as described above. The modelled velocity field of the flow in the spin chamber shows high variation and local disturbances 61.

Figure 9:
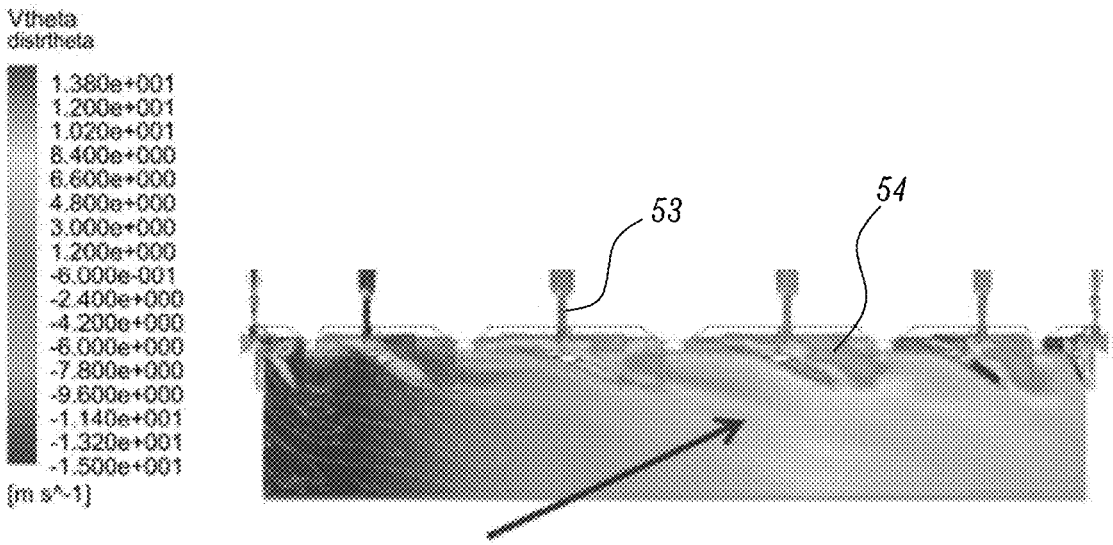
FIG. 9 shows the result of CFD analysis in which a mains flow circuit has restrictor passages and conditioning passages of the type shown in FIGS. 5 and 6.

FIG. 9 shows by contrast the result of CFD analysis in which the mains flow circuit has the restrictor passages 53 and conditioning passages 54 of the type shown in FIGS. 5 and 6. Advantageously, the velocity field of the flow in the spin chamber is much more even and the local disturbances are eliminated.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

I claim:

1. A fuel spray nozzle for generating a spray of atomised liquid fuel in a combustor of a gas turbine engine, wherein the fuel spray nozzle includes:

a flow circuit having an inlet port for receiving a flow of liquid fuel and having an annular exit port for discharging the received flow of liquid fuel as a swirling fuel flow; and an annular prefilming surface downstream of the annular exit port, the annular prefilming surface configured such that the swirling fuel flow received from the annular exit port spreads, as a film of fuel, across the prefilming surface, whereupon one or more swirling air flows generated by the fuel spray nozzle shear the film of fuel towards a trailing edge of the annular prefilming surface and atomise the film of fuel into a spray of fine droplets;

wherein the flow circuit has in flow series:

a gallery which wraps circumferentially around the fuel spray nozzle and receives the flow of liquid fuel from the inlet port;

a plurality of circumferentially-spaced restrictor passages arranged in a row around the fuel spray nozzle, the plurality of restrictor passages receiving respective portions of the flow of liquid fuel from the gallery;

a plurality of conditioning passages which respectively receive the respective portions of the flow of liquid fuel from respective restrictor passages of the plurality of restrictor passages, the plurality of conditioning passages configured to impart a circumferential velocity component to their respective portions of the flow of liquid fuel; and an annular spin chamber which receives and recombines the respective portions of the flow of liquid fuel from the plurality of conditioning passages to form the swirling fuel flow which is discharged at the annular exit port; and wherein:

each restrictor passage of the plurality of restrictor passages form a flow restrictions which in use produces a pressure differential between the gallery and the annular spin chamber to evenly circumferentially distribute the flow of liquid fuel between the plurality of restrictor passages; and each conditioning passage of the plurality of conditioning passages has increased flow cross-sectional areas relative to the flow cross-sectional areas of respective restrictor passage of the plurality of restrictor passages, such that the plurality of restrictor passages produce substantially all of the pressure differential between the gallery and the annular spin chamber.

2. The fuel spray nozzle of claim 1, wherein each restrictor passage of the plurality of restrictor passages extend substantially parallel to each other in an axial direction of the fuel spray nozzle.

3. The fuel spray nozzle of claim 1, wherein each conditioning passage of the plurality of conditioning passages smoothly increase in flow cross-sectional area with downstream distance from the plurality of restrictor passages.

4. The fuel spray nozzle of claim 1, wherein each conditioning passage of the plurality of conditioning passages is further configured to impart a radial velocity component to its respective portion of the flow of liquid fuel.

5. The fuel spray nozzle of claim 1, wherein the flow cross-sectional areas of each conditioning passage of the plurality of conditioning passages is at least two times the flow cross-sectional areas of its respective restrictor passage of the plurality of restrictor passages.

6. The fuel spray nozzle of claim 1, wherein the flow circuit is a mains flow circuit, the flow of liquid fuel received at the inlet port being a mains fuel flow, and wherein the fuel spray nozzle further includes a pilot flow circuit for receiving and discharging a separate pilot fuel flow, whereby the fuel spray nozzle is able to implement staged combustion of the mains and pilot fuel flows.

7. The fuel spray nozzle of claim 1, wherein an atomiser subassembly of the fuel spray nozzle defines the flow circuit, the atomiser subassembly being formed by additive layer manufacture.

8. Combustion equipment for a gas turbine engine, the combustion equipment including a combustor and a plurality of the fuel spray nozzles of claim 1 for generating respective sprays of atomised liquid fuel in the combustor.

9. A gas turbine engine for an aircraft having an engine core, the gas turbine engine comprising in axial flow series a compressor, the combustion equipment of claim 8, and a turbine, a core shaft connecting the turbine to the compressor.

10. The gas turbine engine of claim 9, further comprising:

a fan located upstream of the engine core, the fan comprising a plurality of fan blades; and a gearbox that receives an input from the core shaft and outputs drive to the fan so as to drive the fan at a lower rotational speed than the core shaft.

11. The gas turbine engine of claim 9, wherein:

the compressor is a first compressor, the turbine is a first turbine, and the core shaft is a first core shaft;

the engine core further comprises a second compressor between the first compressor and the combustion equipment, a second turbine between the combustion equipment and the first turbine, and a second core shaft connecting the second turbine to the second compressor; and the second core shaft is arranged to rotate at a higher rotational speed than the first core shaft.

* * * * *